United States Patent [19]

Williams et al.

[11] 4,363,378

[45] Dec. 14, 1982

[54] LADDER SECURING DEVICES AND LADDER ASSEMBLY

[76] Inventors: Richard E. Williams, 106 Lourensriver Rd.; Kenneth J. Budden, 174 Lourensriver Rd., both of Strand, Cape Province, South Africa

[21] Appl. No.: 210,626

[22] Filed: Nov. 26, 1980

[30] Foreign Application Priority Data

Dec. 3, 1979 [ZA] South Africa ..... 79/6560
Jul. 31, 1980 [ZA] South Africa ..... 80/4666

[51] Int. Cl.[3] ..... E06C 7/48

[52] U.S. Cl. ..... 182/93; 182/107; 182/206; 182/214

[58] Field of Search ..... 182/107, 108, 214, 93, 182/206

[56] References Cited

U.S. PATENT DOCUMENTS

| | | | |
|---|---|---|---|
| 1,994,369 | 3/1935 | Risser | 182/107 |
| 2,870,948 | 1/1959 | Lundgren | 182/214 |
| 3,037,579 | 6/1962 | Barrow | 182/107 |
| 3,282,375 | 11/1966 | Ray | 182/214 |
| 3,318,415 | 5/1967 | Christie | 182/214 |
| 3,338,332 | 8/1967 | Brantly | 182/187 |
| 3,715,012 | 2/1973 | Perry | 182/107 |
| 3,792,756 | 2/1974 | Kelly | 182/107 |
| 3,828,889 | 8/1974 | Rehm | 182/107 |
| 3,995,714 | 12/1976 | Brookes | 182/206 |
| 4,130,180 | 12/1978 | Ferguson | 182/187 |

*Primary Examiner*—Reinaldo P. Machado
*Attorney, Agent, or Firm*—Stevens, Davis, Miller & Mosher

[57] ABSTRACT

A ladder securing device which comprises two connectors for attachment to the runners of a ladder. One of the connectors includes a first rotatable element on which is mounted a second rotatable element. The elements are rotatable about axes which are at right angles to one another. A curved metal band is attached to one of said elements and the other connector includes an arrangement such as a locking pin for releasably securing the metal band to it. The arrangement of the first connector is such that the band can pivot about the two axes.

8 Claims, 6 Drawing Figures

LADDER SECURING DEVICES AND LADDER ASSEMBLY

FIELD OF INVENTION

This invention relates to a ladder securing device and to a ladder. It relates more particularly to a ladder securing device for a ladder comprising a pair of spaced runners joined by a plurality of longitudinally spaced rungs; and also to a ladder including such a ladder securing device.

BACKGROUND TO INVENTION

One of the dangers inherent in using a ladder is that the ladder will slip sideways with respect to a pole or the like against which it is leaning. Another danger, although less likely to cause injury than the ladder slipping sideways, is that control of the ladder is lost while it is being placed against the pole or taken down. This is particularly true of extending ladders which must of necessity be pulled away from the pole to enable them to be extended or retracted.

Applicants are aware of various proposals made with a view to minimizing the danger of the ladder slipping. For example, it has been proposed that the top rung of the ladder be of vee shape so that the pole is received in the vee and slipping of the ladder is inhibited. Another solution of which applicants are aware is the provision, at the top of the ladder, of a pair of straps one of which goes around the rear of the pole and the other of which goes around the front of the pole.

The object of the present invention is to provide a ladder securing device which is simple in construction and operation and which has advantages over known ladder securing devices.

A further object of the present invention is to provide a ladder securing device which can be attached to the pole while the ladder is lying horizontally on the ground, or is at a shallow angle, and which remains attached to the pole as the ladder is raised. This minimizes the chances of ladder slip during its extension.

GENERAL DESCRIPTION OF THE INVENTION

According to one aspect of the present invention there is provided a ladder securing device comprising a first connector for attachment to a ladder, a second connector for attachment to a ladder, a fastening element mounted on said first connector and being free to pivot with respect to said first connector about two axes which are mutually at right angles to one another, and means for releasably attaching said fastening element to said second connector.

According to a further aspect of the present invention there is provided in combination a ladder comprising a pair of runners and a plurality of rungs joining the runners, and a device for securing the ladder against slipping when in use, the device comprising a first connector attached to one of the runners of the ladder, a second connector attached to the other runner of the ladder, a fastening element mounted on said first connector and being free to pivot with respect to said first connector about two axes which are mutually at right angles to one another, and means for releasably attaching said fastening element to said second connector.

According to another aspect of the present invention there is provided, in combination, a ladder securing device comprising a first connector including a structure for mounting the first connector on one of the runners of the ladder, a first element mounted on said structure for rotation about a first axis with respect to said structure, a second element mounted on said first element for rotation about a second axis with respect to said first element, said second axis intersecting said second element a first axis at right angles, a curved element mounted on said second connector including a structure for mounting the second connector on the other runner of the ladder, and means for releasably securing to said second connector to the end of said curved element which is remote from its connection to said second element.

According to yet another aspect of the present invention there is provided, in combination, a ladder comprising two runners and a plurality of rungs connecting the runners, and a device for securing the ladder against slipping during use, the securing device comprising a first connector including a structure mounting the connector on one of the runners of the ladder, a first element mounted on said structure for rotation about the first axis with respect to said structure, a second element mounted on said first element for rotation about a second axis with respect to said first element, said second axis intersecting said first axis at right angles, a curved element mounted on said second element, a second connector including a structure mounting the second connector on the other runner of the ladder, and means for releasably securing to said second connector the end of said curved element which is remote from its connection to said second element.

BRIEF DESCRIPTION OF DRAWINGS

The invention is now described, by way of example, with reference to the accompanying drawings, in which.

DESCRIPTION OF FIGURES

Figure 1:
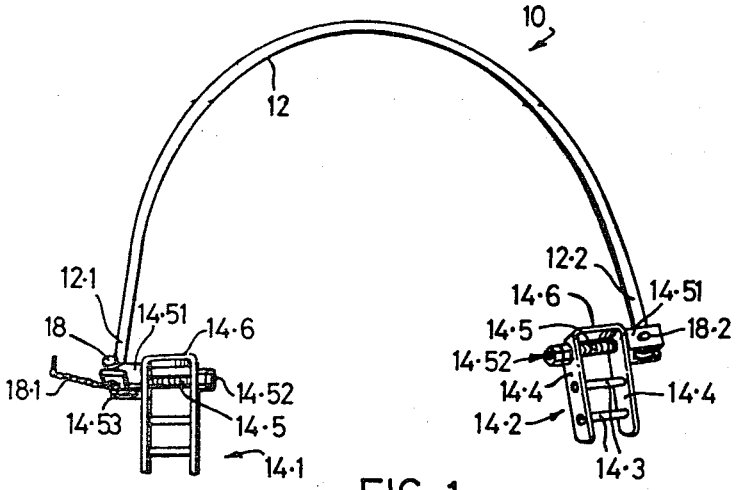
FIG. 1 shows a plan view of a ladder securing device in accordance with the invention.

With reference to FIG. 1 of the drawings, reference numeral 10 generally designates a ladder securing device in accordance with the invention. The device 10 comprises a fastening element in the form of a substantially semi-circular steel band 12 having its ends 12.1, 12.2 each attached to connectors including two U-shaped steel brackets 14.1, 14.2. As can be seen from FIGS. 1–3, this band is substantially rigid. The brackets 14.1, 14.2 are each provided with a pair of bolts 14.3, extending between the limbs 14.4 of the brackets, for connection to the runners of a ladder (not shown in FIG. 1). The ends 12.1, 12.2 of the band 12 are flattened and have openings passing therethrough. The band 12 lies in a single plane, the ends of the band being flattened in the plane of the band and the axes of the openings in said ends extending normal to the said plane. The ends 12.1, 12.2 are attached respectively to the brackets 14.1, 14.2 via links in the form of bolts 14.5. The links 14.5 extend between the limbs 14.4 of the brackets, adjacent the bases 14.6 of the brackets. The head of each link 14.5 comprises attachment means in the form of a pair of parallel spaced, axially outwardly extending lugs 14.51, each having an opening therethrough. The lugs 14.51 of each bracket 14.1, 14.2 are adapted to receive the ends 12.1, 12.2 of the band 12 therebetween, the openings of the lugs registering with the openings of said ends. The opposite ends of the links 14.5 are each provided with a lock nut arrangement 14.52. The lock nut arrangement allows the links to be selectively rotated or fixed with respect to the brackets.

The end 12.1 of the band 12 is detachably attached to the lugs 14.51 of the bracket 14.1 by locking means in the form of a locking pin 18, the pin 18 having a chain 18.1 at one end thereof, a spring-loaded ball, i.e. a detent ball (not shown) protruding transversely from the other end thereof. The pin, in use, passes through the opening of the end 12.1 of the band 12, and the openings of the lugs 14.51, the spring-loaded ball and chain serving to locate the pin 18 in position in the openings. One of the lugs 14.51 of the bracket 14.1 has an extension 14.53, normal thereto, with an opening therein for receiving and holding the pin 18 during transport and storage of the ladder.

The end 12.2 of the band is attached to the bracket 14.2 by a pin 18.2 held captive in the opening of said end 12.2 and in the openings in the lugs 14.51 of the bracket 14.2.

Figure 2:
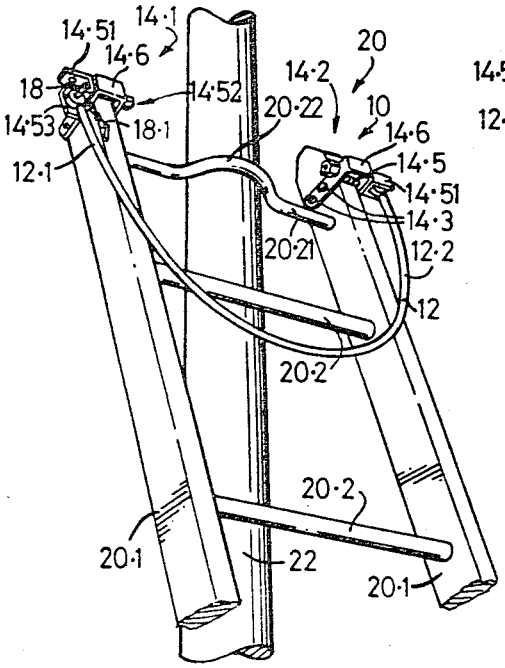
FIG. 2 shows a three-dimensional view of the upper end of a ladder including the device of FIG. 1, in position against a support in the form of a pole, the device being in an inoperative condition.
Figure 3:
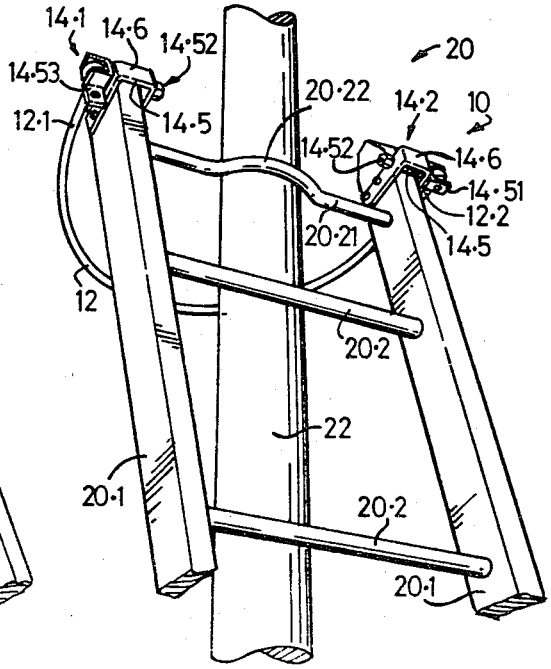
FIG. 3 shows a three-dimensional view from another angle of the upper end of the ladder of FIG. 2, the device being in an operative condition.

In FIGS. 2 and 3 reference numeral 20 designates generally a ladder in accordance with the invention. Unless otherwise specified, like numerals refer to like parts. The ladder 20 is extensible and has two runners 20.1 and a plurality of longitudinally spaced rungs 20.2 joining said runners. The uppermost rung 20.21 has a locating formation in the form of a curved portion 20.22 for receiving a pole 22, thereby to locate the upper portion of the ladder laterally in position against the pole. The brackets 14.1, 14.2 are shown connected to the runners 20.1 of the ladder 20, above the uppermost rung 20.21. The limbs 14.4 of the brackets 14.1, 14.2 respectively straddle the runners. The bolts 14.3 are received in holes through the runners to secure the connection between the brackets and the runners. The bolts 14.5 are spaced from the runners 20.1 and extend inwardly parallel to the rungs 20.2. The heads of the bolts 14.5 are located outwardly of the brackets.

In FIG. 2 the pin 18 is shown attaching the end 12.1 of the band 12 to the extension 14.53 of the one lug 14.51 of the bracket 14.1, the band 12 being in its inoperative condition abutting the runners 20.1 of the ladder 20.

In FIG. 3 the band 12 is shown in its operative condition embracing the pole 22, the end 12.1 being attached by means of the pin 10 to the lugs 14.51 of the bracket 14.1.

The band 12 is pivotable, gimbal fashion, about the axes of the bolts 14.5, i.e. parallel to the rungs 20.2, and also about the axis of the captive pin 18.2 of the bracket 14.1, i.e. normal to the rungs 20.2. The end of the chain 18.1 remote from the pin 18 is attached to the runner 20.1 of the ladder 20 which carries the bracket 14.1.

When the ladder 20 is being transported or stored the band 12 will be pivoted to its inoperative condition as shown in FIG. 2, the pin 18 connecting the end 12.1 of the band 12 to the extension 14.53 of the one lug 14.51 of the bracket 14.1. When the ladder is used, it will be rested against the pole 22 which acts as a support therefor. The curved portion 20,22 of the uppermost rung 22.21 receives the post 22, thereby serving to locate the upper end of the ladder laterally relative to the pole 22. The end 12.1 of the band 12 is then detached from the bracket 14.1 and the band 12 is then pivoted about the axis of the bolt 14.5 of the bracket 14.2, and the axis of the captive pin 18.2 of the bracket 14.2, until it takes up a position on the opposite side of the pole from the ladder 20 as shown in FIG. 3. The end 12.1 of the band 12 is then connected in its operative condition between the lugs 14.51 of the bracket 14.1, by the pin 18.

Figure 4:
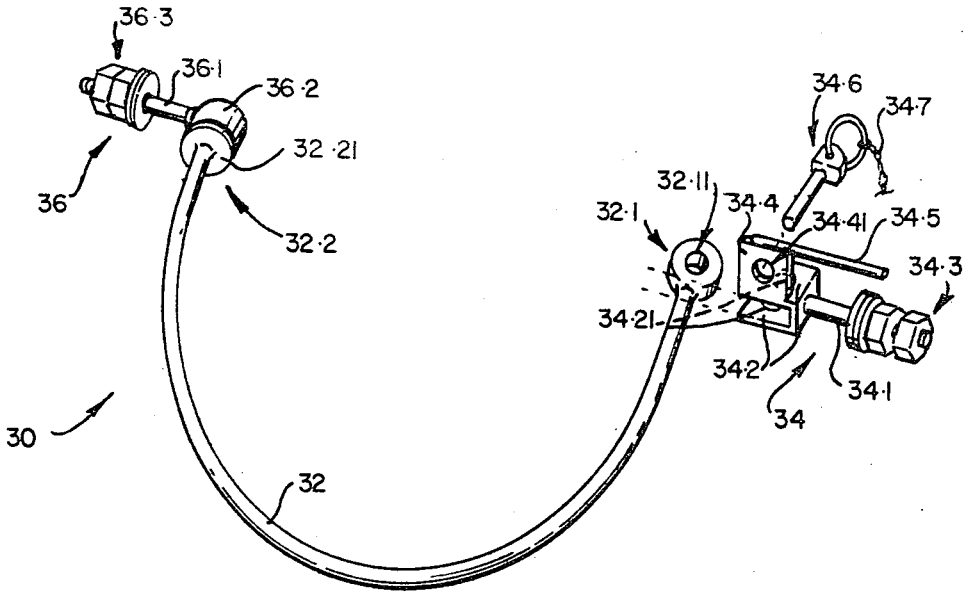
FIG. 4 shows a three-dimensional view from above of another embodiment of a ladder securing device in accordance with the invention.

With reference to FIG. 4, another embodiment of a ladder securing device in accordance with the invention is designated by reference numeral 30. The device 30 comprises connection means in the form of two connectors 34 and 36 for connection to a ladder and a fastening element 32 attached to the connectors. The fastening element 32 comprises a substantially semi-circular steel band curved in one plane and having its ends 32.1 and 32.2 attached to the connectors 34 and 36 respectively, in use. As can be seen from FIGS. 4–6, this band is substantially rigid.

The end 32.1 comprises a flattened boss having an aperture 32.11 normal to the plane of the element 32.

The end 32.2 comprises a peripheral shoulder 32.21 and a stub shaft (which is not shown) at the end of the shoulder 32.21 opposite the end at which it is attached to the steel band.

The connector 34 comprises connection means adapted for connection to a ladder and comprising a spindle 34.1 having a screw-threaded end. Attachment means including a bifurcation having a pair of flattened limbs 34.2 is attached to the spindle 34.1 at its end opposite the screw-threaded end. The limbs 34.2 have aligned apertures 34.21. A washer and lock nut arrangement 34.3 is provided for co-operation with the screw-threaded end of the spindle 34.1 to secure the connection to a ladder. A bracket 34.4 having an aperture 34.41 normal to the apertures 34.21 is fast with one of the limbs 34.2. A pin 34.5 spaced from and parallel to the spindle 34.1 is provided fixed to the edge of the bracket 34.4 remote from the limbs 34.2. In use, the pin 34.5 is received in an aperture in a ladder and prevents rotation of the connector 34. A locking pin 34.6 having an over-center locking ring attached to the device 30 by means of a chain 34.7 (only fragmentarily shown) is provided to attach the end 32.1 to the connector 34. The end 32.1 can be attached to the connector 34 such that the device is in its operative or in its inoperative condition as described in more detail hereinafter. In its inoperative condition, the apertures 32.11 and 34.41 are aligned and the pin passed through the apertures and locked in position by means of the locking ring. In its operative condition the end 32.1 is received between the limbs 34.2 with the apertures 32.11 and 34.21 in alignment. The pin 34.6 is passed through the apertures and locked in position by means of the locking ring.

The connector 36 comprises a spindle 36.1 having, at opposite ends, a screw-threaded end and flattened head in the form of a boss 36.2 having an aperture (not shown) for pivotally receiving the stub shaft of the end 32.2. A washer and lock nut arrangement 36.3 is provided to co-operate with the screw-threaded end of the spindle 36.1 to secure connection of the connector 36 to a ladder.

Figure 6:
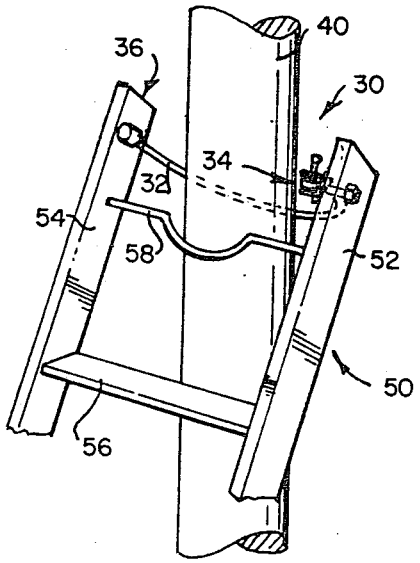
FIG. 6 shows a three-dimensional view of the upper end of a ladder including the device of FIG. 4, in position against a support in the form of a pole.

With reference also to FIG. 6, the device 30 is shown connected to a ladder 50 comprising runners 52 and 54, a plurality of rungs 56 (of which only one is shown) joining the runners 52 and 54 and an uppermost steel rung 58 having a curved centre portion. The spindle 34.1 and the pin 34.5 of the connector 34 are received in apertures through the runner 52 such that the apertures 34.21 are disposed longitudinally, and the aperture 34.41 normal to the runner 52. The washer and lock nut arrangement 34.3 co-operates with the screw-threaded end of the spindle 34.1 to secure the connector 34 to the runner 52. The spindle 36.1 of the connector 36 is pivotally received in an aperture in the runner 54 parallel to the rungs 56 and 58. The connectors 34 and 36, when connected to the ladder 50, are disposed opposite to each other such that the element 32 extends between them and thus between the runners 52 and 54.

In its inoperative position the fastening element lies in the plane of the runners 52 and 54, the fastening element 32 being attached to the connector 34 via the bracket 34.4.

In use, the ladder 50 is placed against a support such as a pole 40. The curved centre portion of the uppermost rung 58 engages the outer periphery of the pole 40 to support the ladder 50 and to locate it laterally relative to the pole 40.

Figure 5:
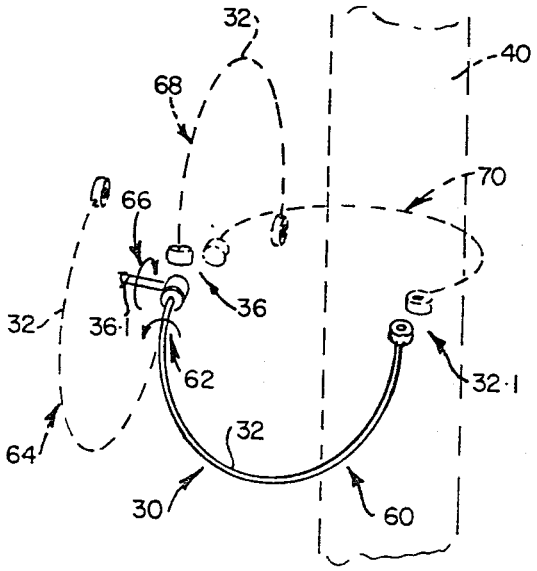
FIG. 5 shows, schematically in three-dimensional view, the motions of the device of FIG. 4 when it is moved from an inoperative to an operative condition.

With reference also to FIG. 5, to displace the device 30 from its inoperative to its operative condition the locking pin 34.6 is removed and the element pivoted from its inoperative condition, indicated by reference numeral 60, about the stub shaft of the end 32.2, as indicated by arrow 62, to a first intermediate position shown in dotted lines and indicated by reference numeral 64. The element 32 is then pivoted about the spindle 36.1, in the direction indicated by arrow 66, to a second intermediate position 68 shown in dotted. Finally, the element 32 is pivoted simultaneously about the stub shaft of the end 32.2 and the spindle 36.1 to its operative condition indicated by reference numeral 70 and also as shown in FIG. 6. When in its operative condition, the end 32.1 is received between the limbs 34.2 such that the apertures 32.11 and 34.21 are aligned. The pin 34.6 is passed through the aligned apertures and locked in position by means of the locking ring.

When the fastening element is in its operative condition, it and the uppermost rung 58 embrace the pole 40 and locate the upper end of the ladder 50 about the pole 40.

We claim:

1. A ladder securing device comprising a substantially rigid fastening element, a first connector for attachment to a ladder, said first connector comprising a first element for connection to the ladder, a second element connected to said first element and selectively rotatable with respect to the first element about a first axis, and a third element for rotatably securing said fastening element to said second element, capable of allowing rotation of said fastening element about a second axis perpendicular to said first axis, a second connector for attachment to a ladder, and means for releasably attaching said fastening element to said second connector.

2. A device according to claim 1, in which said fastening element is constituted by a metal band.

3. A device according to claim 2, in which said metal band is semi-circular in form.

4. A device according to claim 2 or 3, in which said band has an aperture at the end thereof which connects to the second connector, said aperture serving to receive a connecting pin.

5. A device according to claim 1, 2 or 3, in which each connector comprises a bracket for embracing one of the runners of a ladder, and means adapted to pass through the bracket and the runner to secure the bracket to the runner, the bracket of said first connector constituting said first element.

6. In combination a ladder comprising a pair of runners and a plurality of rungs joining the runners, and a device for securing the ladder against slipping when in use, the device comprising a substantially rigid fastening element, a first connector attached to one of the runners of the ladder, said first connector comprising a first element connected to said one runner, a second element connected to said first element and selectively rotatable with respect to the first element about a first axis, and a third element for rotatably securing said fastening element to said second element, capable of allowing rotation of said fastening element about a second axis perpendicular to said first axis, a second connector attached to the other runner of the ladder, and means for releasably attaching said fastening element to said second connector.

7. A ladder securing device comprising a first connector including a structure for mounting the first connector on one of the runners of the ladder, a first element mounted on said structure for rotation about a first axis with respect to said structure, a second element mounted on said first element for rotation about a second axis with respect to said first element, said second axis intersecting said first axis at right angles, a substantially rigid curved fastening element mounted on said second element, a second connector including a structure for mounting the second connector on the other runner of the ladder, and means for releasably securing to said second connector the end of said curved element which is remote from its connection to said second element.

8. In combination a ladder comprising two runners and a plurality of rungs connecting the runners, and a device for securing the ladder against slipping during use, the securing device comprising a first connector including a structure mounting the connector on one of the runners of the ladder, a first element mounted on said structure for rotation about a first axis with respect to said structure, a second element mounted on said first element for rotation about a second axis with respect to said first element, said second axis intersecting said first axis at right angles, a curved substantially rigid fastening element mounted on said second element, a second connector including a structure mounting the second connector on the other runner of the ladder, and means for releasably securing to said second connector the end of said curved substantially rigid fastening element which is remote from its connection to said second element.

* * * * *